United States Patent [19]

Wechner

[11] Patent Number: 4,932,481

[45] Date of Patent: Jun. 12, 1990

[54] ROOF BOLT DRILL SUPPORT

[75] Inventor: Edward Wechner, New South Wales, Australia

[73] Assignee: Joy Technologies Inc., Pittsburgh, Pa.

[21] Appl. No.: 240,887

[22] Filed: Sep. 2, 1988

[30] Foreign Application Priority Data

Sep. 4, 1987 [AU] Australia ..... PI4166

[51] Int. Cl.[5] ..... E21C 11/00

[52] U.S. Cl. ..... 173/141; 173/34; 173/36; 173/140

[58] Field of Search ..... 173/34, 36, 140, 141, 173/148, 160, 81, 57; 277/212 FB, 212 F, 152, 58

[56] References Cited

U.S. PATENT DOCUMENTS

| | | | |
|---|---|---|---|
| 3,126,063 | 3/1964 | Pitt et al. | 173/152 |
| 3,273,658 | 9/1966 | Ytterfors et al. | 173/141 |
| 3,871,665 | 3/1975 | Burke et al. | 277/212 F X |
| 4,042,248 | 8/1977 | Williamitis | 277/152 X |
| 4,448,263 | 5/1984 | Becker et al. | 173/134 |

*Primary Examiner*—Frank T. Yost
*Assistant Examiner*—Rinaldi Rada
*Attorney, Agent, or Firm*—Kirkpatrick & Lockhart

[57] ABSTRACT

A mining roof bolt drill feed mechanism whereby the drill is supported on a horizontal pylon extending from an elongate slot in a vertical box section inner strut. The inner strut telescopes within an outer box section strut with an aligned elongate slot, and the pylon is supported on the nut of a dual concentric worm and nut drive system located within the telescopic struts. Elastomeric seals are provided over the elongate slots to prevent the ingress of dust from the mining operation.

6 Claims, 2 Drawing Sheets

ROOF BOLT DRILL SUPPORT

FIELD OF THE INVENTION

This invention relates to a roof bolt drill support and has been devised particularly as a feed mechanism for a mining roof bolt drill.

BACKGROUND OF THE INVENTION

Roof bolt drills commonly used at present in mines, and in particular on continuous mining machines, are supported on bulky frame structures incorporating vertical guides to guide the drill pot as it is advanced upwardly in the drilling operation. The drive mechanism for vertical movement of the drill pot is commonly driven by way of an external chain and sprocket mechanism. This drive system is bulky and takes up considerable room on the miner, causing the drill pots to be spaced apart by a considerable distance which reduces the rate at which the roof can be effectively drilled for the placement of roof bolts and/or reduces the safety of the roof in the mining operation.

It is desirable to provide a roof bolt drill feed mechanism which, while being robust and simple in operation, is compact in dimension, enabling adjacent drill pots to be placed closely together, and also close to the cutting face of the mining machine.

SUMMARY OF THE INVENTION

The present invention therefore provides a roof bolt drill feed mechanism comprising telescopic inner and outer elongate box section struts having aligned open slots down the mid face of one side thereof, a dual concentric worm and nut drive system located within the inner strut, and a drill pot support Pylon mounted on the nut and protruding outwardly through the slots to support a drill pot rig.

Preferably the slots are closed by elastomeric seals on either side thereof, clamped to the adjacent face of the struts and touching at the centreline of the slot.

Preferably the seals are V-shaped in cross section, the seals of the outer strut nesting in the seals of the inner strut.

DESCRIPTION OF THE DRAWINGS

Notwithstanding any other forms that may fall within its scope, one preferred form of the invention will now be described by way of example only with reference to the accompanying drawings, in which.

DESCRIPTION OF THE PREFERRED EMBODIMENT

Figure 1:
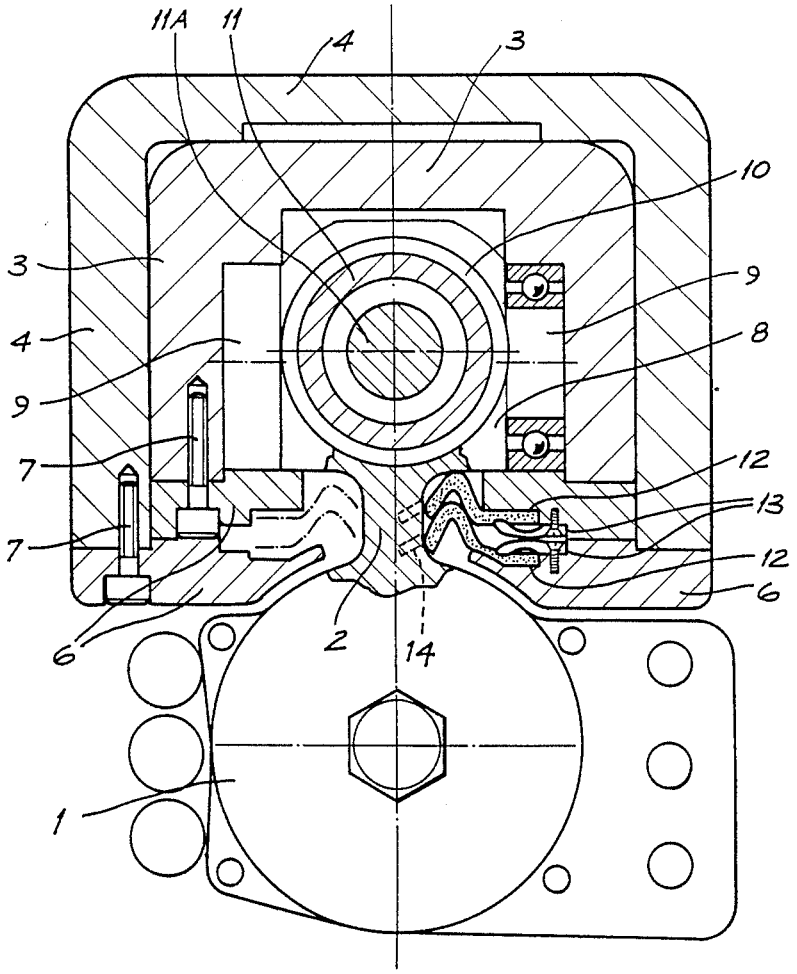
FIG. 1 is a horizontal section through a roof bolt drill feed mechanism according to the invention.

In the preferred form of the invention, a drill pot (1) is supported by way of a pylon (2) from an elongate vertical tower (2A) formed from an inner box section strut (3) telescopically sliding within an outer elongate box section strut (4).

Each box section strut is typically formed from heavy duty channel and provided with re-entrant faces on the fourth side by way of plates (6) clamped to the edges of the channel sections by socket bolts (7). The inner strut (3) can slide or telescope within the outer strut (4) to enable the overall length of the strut to be lengthened or shortened.

Figure 3:
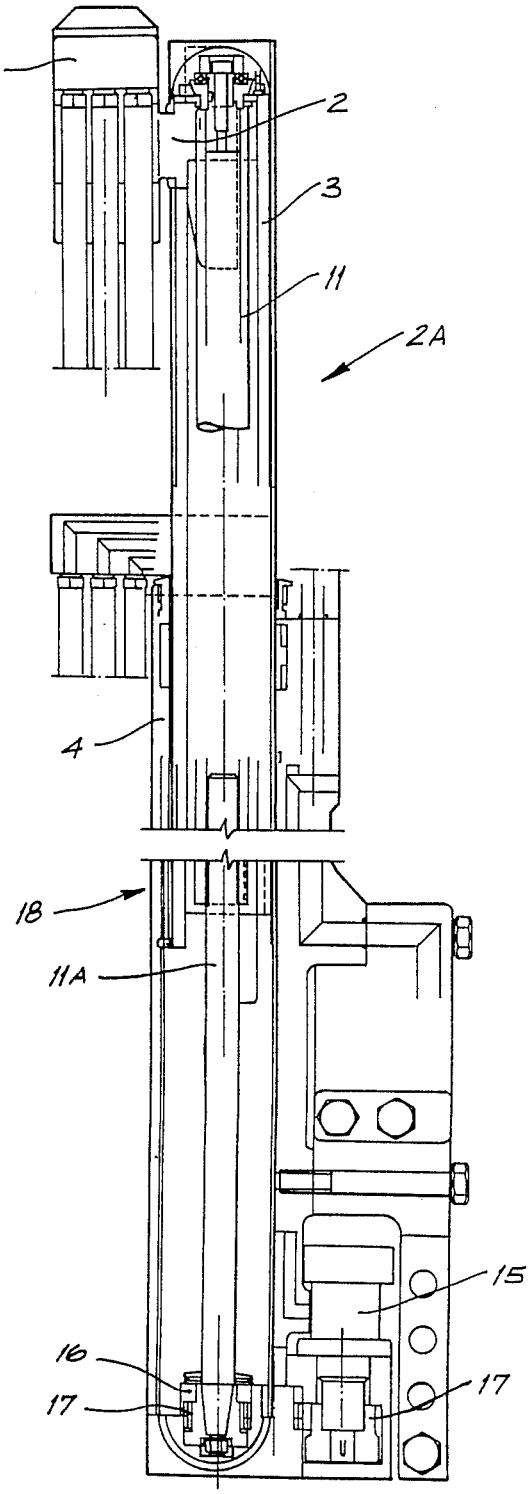
FIG. 3 is a side elevation, in partial section, of the roof bolt drill feed mechanism according to the invention.

The drill pot pylon (2) is supported by a platform (8) located within the inner strut (3) and which is provided with guide rollers (9) having a diameter slightly less than the distance between the inner faces of the plates 6) and the inner faces of the inner box section s strut (3) opposite thereto so that there is small clearance between the inner faces of the inner strut (3) allowing the rollers to roll against either pair of inner faces of the box section and react any off-centre loads from the drill pot (1). The platform (8) is engages with a nut (10) which in turn is threadedly engaged with the outer portion (11) of a dual concentric worm rotatably mounted at the centre of the inner strut (3). The dual concentric worm is driven by a suitable drive motor (15) on the mining machine to rotate the worm within the nut and hence cause the nut to move up and down the worm. The dual concentric worm comprises an inner member (11A) (FIG. 3) supported in a lower bearing (16) and driven by gears (17) from the motor (15). The inner member (11A) has an external thread which engages with an internal thread in the outer member (11) as shown at (18). The hollow outer member (11) in turn has an external thread engaged with the nut (10).

The opening between the pairs of face plates (6), which forms an elongate slot down the length of the struts, is closed by elastomeric seals (12) located on either side of the slot. (The seals on one side only are shown in the accompanying drawing for clarity). Each seal is V-shaped in cross section and held in place by a clamping plate (13). This seal shape gives the maximum scope for deflection and/or compliance with the pylon (2) in a very restricted cross-sectional area.

Figure 2:
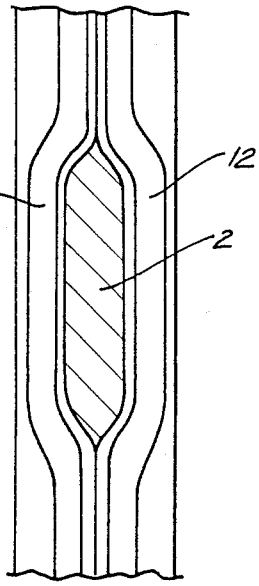
FIG. 2 is a vertical section scrap view to an enlarged scale of the drill pot support pylon used in the drill feed mechanism.

Because of the V-shaped cross section of the seals, the seals of the outer strut (4) nest neatly within the V of the seals of the inner strut (3) as shown in the drawing, providing an effective seal between the struts as they telescope one within the other. The seals are pushed back by the movement of the pylon (2) to the positions shown in solid outline in the accompanying drawing, but as the pylon Passes, the seals move inwardly to the position (14) shown in broken outline, effectively sealing the opening to the inside of the struts, effectively preventing coal dust or other minerals from entering and damaging the dual concentric worm and nut drive system. This action can be clearly seen in FIG. 2.

Because of the large range of travel given by the dual concentric worm and nut system, and the telescopic struts, a drill pot feed mechanism can be provided which, while retaining the effective range of travel needed for drilling deep drill holes for roof bolts, is itself compact and takes up little room on the mining machine.

What is claimed is:

1. A roof bolt drill feed mechanism comprising telescopic inner and outer elongate box section struts having aligned open slots down the mid face of one side thereof, a dual concentric worm and nut drive system located within the inner strut, and a drill pot support pylon mounted on the nut and protruding outwardly through the slots to support a drill pot rig, wherein slots are close by elastomeric seals on either side thereof, clamped to the adjacent face of the struts and touching at the centerline of the slot.

2. A roof bolt drill feed mechanism as claimed in claim 1, wherein the seals are V-shaped in cross section, the seals of the outer strut nesting in the seals of the inner strut.

3. A roof bolt drill feed mechanism as claimed in claim 1, wherein the dual concentric worm is rotated by a drive motor located adjacent the lower end of the outer strut.

4. A roof bolt drill feed mechanism comprising telescopic inner and outer elongate box section struts having aligned open slots down the mid face of one side thereof, a dual concentric worm and nut drive system located within the inner strut, and a drill pot support pylon molted on the nut and protruding outwardly through the slots to support a drill pot rig wherein the nut is provided with guide rollers on either side of the pylon, the roller being engaged with the inner faces of the inner strut on said one side and on the side opposite thereto to react loads from the drill pot rig on the pylon.

5. A roof bolt drill feed mechanism as claimed in claim 4, wherein the rollers comprise a pair of rollers mounted either side of the nut on a common axis perpendicular to the pylon and to the axis of the inner strut, the diameter of each roller being slightly less than the distance between the corresponding opposite inner faces of the inner strut.

6. A roof bolt drill feet mechanism as claimed in claim wherein the dual concentric form is rotated by a drive motor located adjacent the lower end of the outer strut.

* * * * *

UNITED STATES PATENT AND TRADEMARK OFFICE

CERTIFICATE OF CORRECTION

PATENT NO. : 4,932,481

DATED : June 12, 1990

INVENTOR(S) : Edward Wechner

It is certified that error appears in the above-identified patent and that said Letters Patent is hereby corrected as shown below:

Col. 2, line 9, delete "s" after the word "section".

Col. 2, line 10, insert --a-- after the word "is" and before the word "small".

Col. 2, line 45, delete "Passes," and substitute therefor --passes,--.

Col. 3, line 14, delete "molted" and substitute therefor --mounted--.

Col. 3, line 15, after "rig" insert --,--.

Col. 4, line 2, delete "roller" and substitute therefor --rollers--.

Signed and Sealed this

Third Day of September, 1991

*Attest:*

*Attesting Officer*

HARRY F. MANBECK, JR.

*Commissioner of Patents and Trademarks*